US010955776B1

(12) United States Patent
Cao et al.

(10) Patent No.: US 10,955,776 B1
(45) Date of Patent: Mar. 23, 2021

(54) POWER CONTROL FOR A FUSER OF AN IMAGING DEVICE

(71) Applicant: LEXMARK INTERNATIONAL, INC., Lexington, KY (US)

(72) Inventors: Jichang Cao, Lexington, KY (US); John Lemaster, Lexington, KY (US); William Alan Menk, Jr., Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/737,990

(22) Filed: Jan. 9, 2020

Related U.S. Application Data

(60) Provisional application No. 62/931,275, filed on Nov. 6, 2019.

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ... G03G 15/2039; G03G 15/205; G03G 15/80
See application file for complete search history.

(56) References Cited

U.S. PATENT DOCUMENTS

2003/0103778 A1* 6/2003 Meads ..... G03G 15/205 399/88
2013/0114969 A1* 5/2013 Wakide ..... G03G 15/5004 399/88

* cited by examiner

*Primary Examiner* — Hoang X Ngo

(57) ABSTRACT

An imaging device includes a fuser having a heater connected to a power source via a switch. A controller generates a heater control signal for driving the heater without synchronizing the generation of the heater control signal with zero crossings of an AC voltage of the power source. The heater control signal changes between a first state indicating for the heater to be turned on and a second state indicating for the heater to be turned off. A trigger circuit receives the heater control signal and detects whether the AC voltage is within a predefined voltage span around zero volts. The trigger circuit generates a trigger signal for the switch when the AC voltage is within the predefined voltage span while the heater control signal is in the first state such that the switch causes current to pass through from the power source to the heater.

16 Claims, 6 Drawing Sheets

POWER CONTROL FOR A FUSER OF AN IMAGING DEVICE

This application claims priority to U.S. Provisional Patent Application Ser. No. 62/931,275, filed Nov. 6, 2019, entitled "Power Control for a Fuser of an Imaging Device," the content of which is hereby incorporated by reference in its entirety.

BACKGROUND

Field of the Invention

The present disclosure relates in general to alternating current (AC) power control systems, and more particularly to power control methods and apparatus for controlling the AC power delivered to a fuser of an imaging device, such as a printer, copier, all-in-one, etc., without using a zero cross (ZC) circuit.

Description of Related Art

In an electrophotographic (EP) imaging process used in laser printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to a media sheet intended to receive the final image. The toner image is fixed to the media sheet by the application of heat and pressure in a fuser assembly. The fuser assembly may include a heated roll and a backup roll forming a fuser nip through which the media sheet passes. Alternatively, the fuser assembly may include a fuser belt, a heater disposed within the belt around which the belt rotates, and an opposing backup member, such as a backup roll.

Imaging devices typically draw power from an electrical power grid, i.e., the AC (alternating current) line power, in order to operate. During a fusing operation, the fuser assembly draws relatively large amounts of power to heat the fuser that may cause large voltage variations which, in turn, may generate severe harmonics and noticeable flicker. In most geographical locations, strict certification requirements such as flicker, harmonics, current symmetry, radiation, and conduction requirements are set to reduce their undesirable effects on health and/or other sensitive electronic/electrical equipment. As a result, manufacturers of imaging devices are continuingly challenged to meet these requirements while not compromising temperature control performance.

In some imaging devices, the heater associated with the fuser is turned on only during half-cycle boundaries corresponding to zero crossings of the AC signal in order to reduce harmonics, radiation, and conduction issues. To detect zero crossings, a zero cross circuit is typically employed which provides zero-cross feedback pulses that are used by a controller to determine when to turn the heater on or off. However, the inclusion of a zero cross circuit presents added cost to the imaging device. The inventors recognize a need for implementing a fuser power control system that can achieve such certification requirements at a lower cost.

SUMMARY OF THE INVENTION

The foregoing and other are solved by a fuser power control system that generates drive signals for a fuser of an imaging device without requiring zero-cross feedback from a zero-cross circuit to generate the drive signals. In one embodiment, the imaging device includes a power source for supplying power to a heater of the fuser. A switch, such as a triac, is connected between the heater and the power source for selectively allowing current to pass from the power source through the heater. A controller generates a heater control signal for driving the heater to generate heat without synchronizing the generation of the heater control signal with zero crossings of an alternating current (AC) voltage of the power source. In one example form, the heater control signal changes between a first state indicating for the heater to be turned on and a second state indicating for the heater to be turned off. A trigger circuit, such as an opto triac, is coupled to the controller to receive the heater control signal from the controller. The trigger circuit is operative to detect whether the AC voltage of the power source is within a predefined voltage span around zero volts. The trigger circuit generates a trigger signal for the switch in response to detecting that the AC voltage is within the predefined voltage span while the heater control signal is in the first state such that the switch causes current to pass through from the power source to the heater.

In another embodiment, a method is disclosed for controlling power delivered to a fuser in an imaging device. The method includes receiving a heater control signal for driving a heater of a fuser of the imaging device, the heater control signal changing between a first state indicating for the heater to be turned on and a second state indicating for the heater to be turned off. In one aspect, the heater control signal includes a predetermined group of pulses. In another aspect, the heater control signal includes a predetermined pulse waveform pattern. The method further includes detecting whether an alternating current (AC) voltage of the power source is within a predefined voltage span around zero volts. In response to detecting that the AC voltage is within the predefined voltage span while the heater control signal is in the first state, a trigger signal is sent to a switch that turns on the heater by allowing current to pass through from a power source to the heater. On the other hand, when it is detected that the AC voltage is within the predefined voltage span while the heater control signal is in the second state, sending of the trigger signal to the switch is bypassed. When it is detected that the AC voltage is outside the predefined voltage span regardless of whether the heater control signal is in the first state or the second state, sending of the trigger signal to the switch is also bypassed.

In another embodiment, a method is disclosed for controlling power delivered to a fuser in an imaging device. The fuser has a heater connected to a power source via a switch. The method includes generating, by a controller, a heater control signal for driving the heater without synchronizing the generation of the heater control signal with zero crossings of an alternating current (AC) voltage of the power source. The heater control signal changes between a first state indicating for the heater to be turned on and a second state indicating for the heater to be turned off. The method further includes receiving the heater control signal by a trigger circuit, and detecting by the trigger circuit whether the AC voltage of the power source is within a predefined voltage span around zero volts. The trigger circuit generates a trigger signal for the switch in response to detecting that the AC voltage is within the predefined voltage span while the heater control signal is in the first state. In response to receiving the trigger signal, the switch connects the heater to the power source such that current passes from the power source through the heater. In one aspect, receiving the heater control signal includes receiving a plurality of predetermined pulse waveform patterns. A delay is set between successive predetermined pulse waveform patterns by increasing a low time of the heater control signal corresponding to the second state between successive predetermined pulse waveform patterns. In another aspect, receiving the heater control signal includes receiving a plurality of pulses with each pulse having a pulse width that is greater than a width defined by the predefined voltage span. In still another aspect, the predefined voltage span ranges between about −20 volts and about +20 volts.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein. Like numerals represent like features in the drawings.

DETAILED DESCRIPTION OF THE INVENTION

It is to be understood that while the preferred embodiments herein incorporate AC power delivery for an imaging device, the principles and concepts can be utilized in many other applications. Applications that are especially well adapted for using the features of the invention include those where AC power is to be delivered to a load, and the load requires different magnitudes of AC power delivered thereto. Other applications include those where the use of AC power is likely to cause flicker and the generation of harmonic energy. The features of the invention can be utilized with AC power systems having frequencies and voltages different from that used in the United States.

Figure 1:
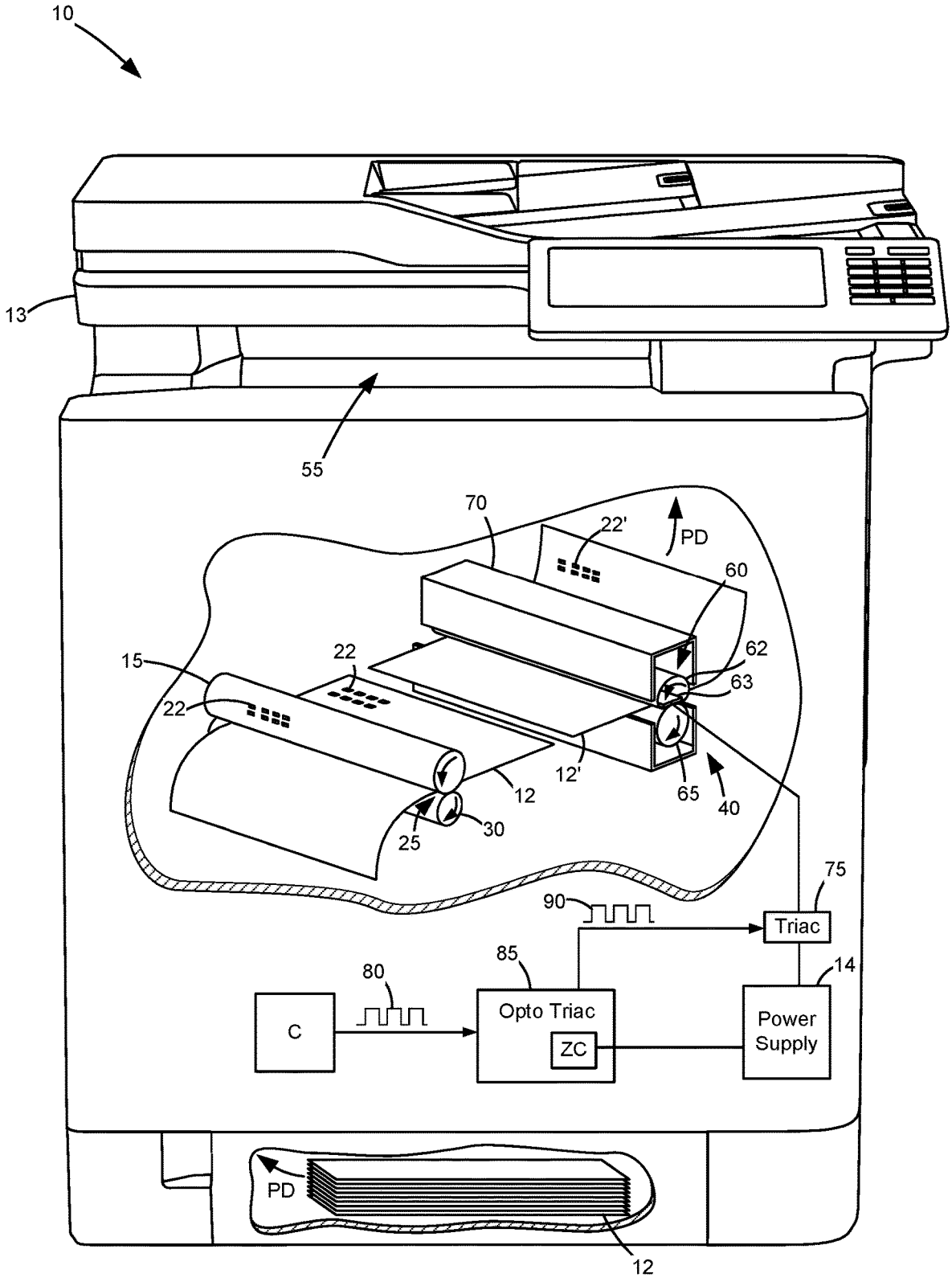
FIG. 1 is a diagrammatic view of an imaging device, including cutaway with a diagrammatic view of a fuser assembly.

With reference to FIG. 1, an electrophotographic imaging device 10 is shown according to an example embodiment. Imaging device 10 is used for printing images on media 12. Image data of the image to be printed on the media is supplied to imaging device 10 from a variety of sources such as a scanner 13, computer, laptop, mobile device, or like computing device. The sources directly or indirectly communicate with imaging device 10 via wired and/or wireless connection. A controller (C), such as an ASIC(s), circuit(s), microprocessor(s), etc., receives the image data and controls hardware of imaging device 10 to convert the image data to printed data on the sheets of media 12. A power source 14, which may include a low voltage power supply and/or a high voltage power supply, provides power to many of the components and modules of imaging device 10.

During use, controller (C) controls one or more laser or light sources (not shown) to selectively discharge areas of a photoconductive (PC) drum 15 to create a latent image of the image data thereon. Toner particles are applied to the latent image to create a toned image 22 on PC drum 15. At a transfer nip 25 formed between PC drum 15 and a transfer roll 30, the toned image 22 from PC drum 15 is transferred to a media sheet 12 travelling in a process direction PD. Media sheet 12' with toned image 22 enters a fuser 40 to be applied with heat and pressure in order to fuse toned image 22 to media sheet 12'. Media sheet 12' with fused toner image 22' exits fuser 40 and is either deposited into an output media area 55 or enters a duplex media path for transport to PC drum 15 for imaging on the other side of the media sheet 12'.

In the example shown, fuser 40 has a heat transfer member 60 and a backup roll 65 disposed within a housing 70. Heat transfer member 60 and backup roll 65 forms a fusing nip therebetween. Heat transfer member 60 includes an endless fuser belt 62 and a heater 63 that contacts an inner surface of fuser belt 62 so that heat generated by heater 63 heats fuser belt 62 to a temperature sufficient to perform a fusing operation on sheets of media at the fusing nip. Heater 63 may be formed from a substrate of ceramic or like material to which at least one resistive trace is secured which generates heat when a current is passed through it. Backup roll 65 contacts fuser belt 62 such that fuser belt 62 rotates in response to backup roll 65 rotating, as indicated by their direction arrows, to convey media through the fusing nip in process direction PD.

In one embodiment, power is applied to heater 63 for fusing sheets of media using multiple AC half-cycle control. Specifically, at each AC half-cycle, heater 63 is turned either fully-on or fully-off such that no intermediate power level therebetween is delivered. Since only half or full cycles are used per AC cycle, switching of heater 63 between its on and off states occurs only during half-cycle boundaries corresponding to the zero crossings of the AC signal thereby reducing and/or preventing the generation of harmonics. In the example shown, a triac 75 connected between heater 63 and power source 14 is used to switch heater 63 on and off based on a heater control signal, shown as heat-on pulses 80, generated by controller (C). In a further embodiment, controller (C) generates heat-on pulses 80 without synchronizing the generation of the heat-on pulses with zero-crossings of the AC line voltage such that controller (C) does not require any zero-cross feedback signal as input in order to generate heat-on pulses 80 for controlling triac 75. Instead, controller (C) works in conjunction with an opto triac 85 having zero cross (ZC) functionality to generate trigger pulses 90 for triggering triac 75 and provide AC power to heater 63 at about the zero crossings of the AC signal, as will be discussed in greater detail below. Depending on the dynamic AC power requirements of heater 63, controller (C) produces heat-on pulses 80 ( ) to deliver AC power in a three-cycle mode, or a two-cycle mode, or both.

Controller (C) generates heat-on pulses 80 based on an amount of power to be delivered to heater 63 to achieve a target and/or desired fusing temperature. If fuser 40 is not at the desired temperature, the power change can be instituted to increase or decrease the AC power delivered to heater 63. If power is to be increased, for example, then controller (C) can correlate the desired increase in power to a table to determine the pulse waveform pattern of the triac trigger signals to achieve such power. In carrying out the changes in the AC power delivered to heater 63, various algorithms can be employed such as proportional-integral-derivative (PID) algorithms to assure that the rate of change in the power is proper so as to minimize any undershoot or overshoot.

In the example shown, opto triac 85 receives heat-on pulses 80 from controller (C) as input and allows activation of triac 75 when the AC line voltage is around zero voltage as detected by its built-in ZC detector. In this regard, opto triac 85 has a specific parameter called 'Inhibit Voltage' which defines the +/− voltage span around zero volts where opto triac 85 sends out a trigger pulse to triac 75 when the heat-on pulse 80 it receives from controller (C) is high in order to turn on heater 63.

Figure 2:
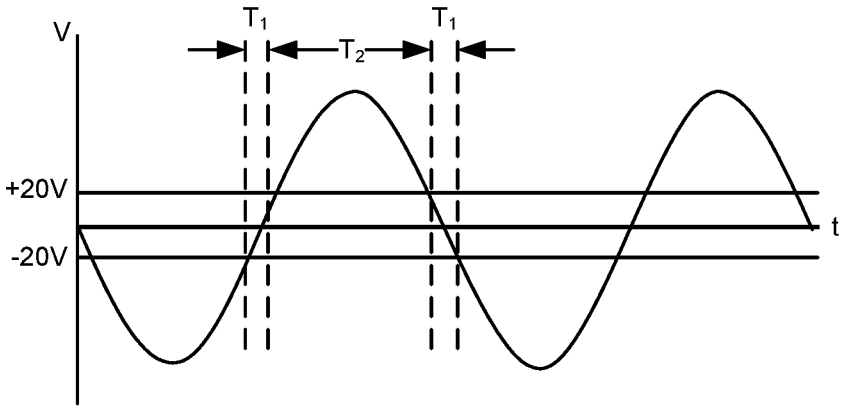
FIG. 2 illustrates an example waveform having a voltage span around zero volts dividing an AC half-cycle into regions as defined by an inhibit voltage of +/−20V.
Figure 3:
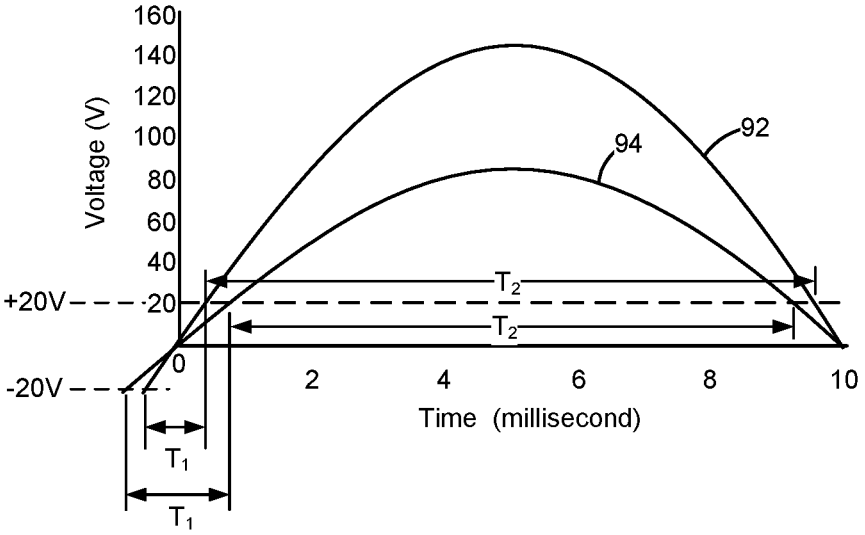
FIG. 3 shows example waveforms illustrating changes in the half-cycle regions as voltage amplitude changes.

In FIGS. 2 and 3, operational characteristic of opto triac 85 is illustrated by using example waveforms. FIG. 2 illustrates a voltage span around zero volts of the second AC voltage half-cycle defined by a maximum inhibit voltage of +/−20V. As shown, the maximum inhibit voltage divides the AC voltage half-cycle into regions: ON region $T_1$ and inhibit region $T_2$. While within the ON region $T_1$, opto triac 85 can send a trigger pulse 90 to triac 75 when the heat-on pulse 80 is high to turn on heater 63. On the other hand, while within the inhibit region $T_2$, opto triac 85 is disabled from sending any trigger pulse to triac 75 such that heater 63 cannot be turned on by the heat-on pulse 80 irrespective of whether the heat-on pulse 80 is high or low. In other words, heater 63 may be turned on only around zero volts when heat-on pulse 80 is high. The ranges of regions $T_1$ and $T_2$ may vary depending on the AC voltage waveform characteristics, e.g., voltage amplitude and frequency. For example, in FIG. 3, two example waveforms 92, 94 are shown having the same frequency but different amplitudes with waveform 92 having a greater voltage amplitude than waveform 94. With frequency fixed, ON region $T_1$ decreases and inhibit region $T_2$ increases as AC voltage amplitude increases. The ranges of regions $T_1$ and $T_2$ define the response of opto triac 85 to heat-on pulses 80 and may be selected depending on the voltages supported by the imaging device.

Figure 4:
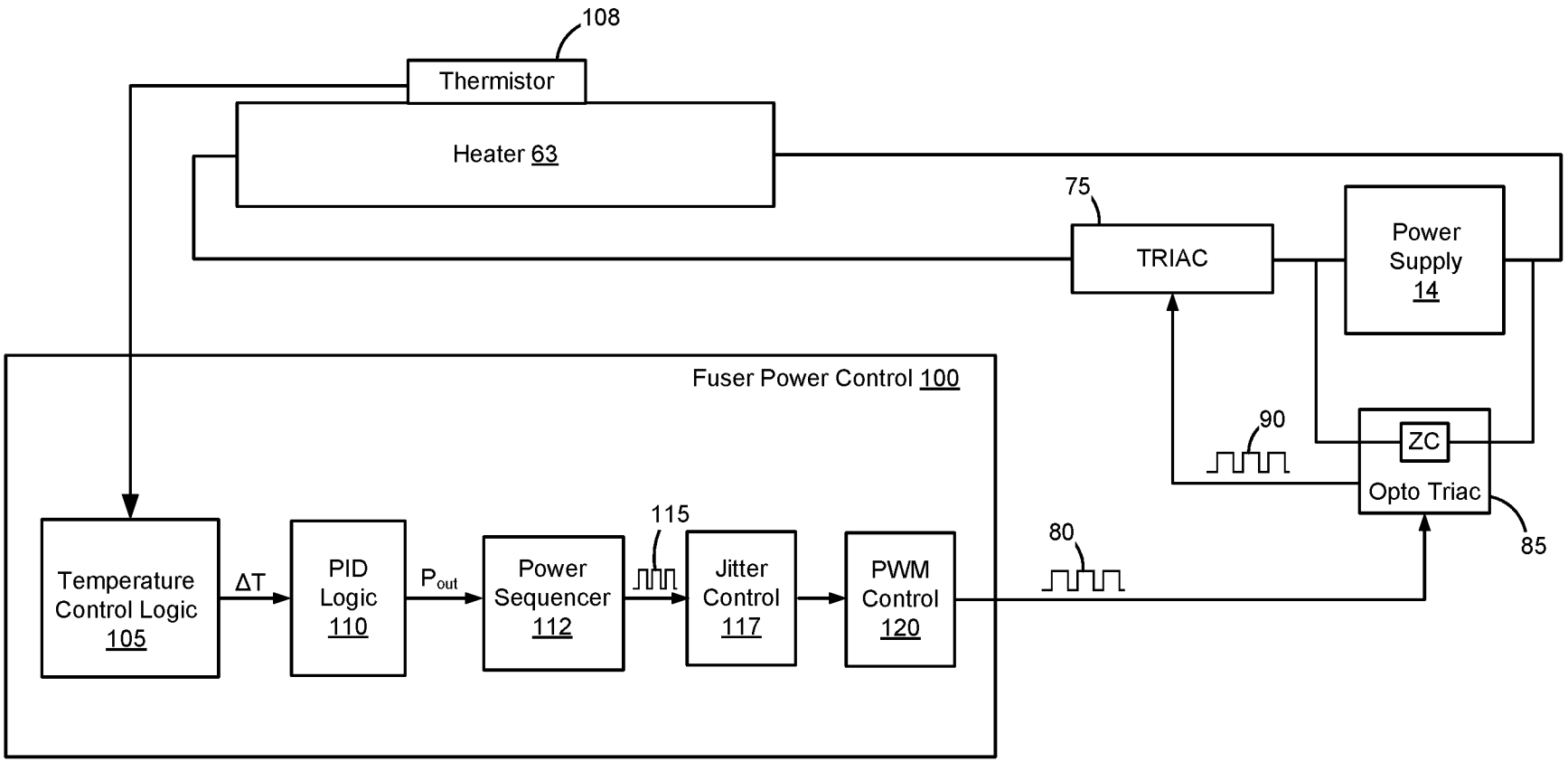
FIG. 4 illustrates a fuser power control system according to an example embodiment.

FIG. 4 illustrates in block diagram form a fuser power control system according to one example embodiment. A fuser power control block 100, which may be implemented in controller (C) or provided separately from controller (C), controls power delivered from power source 14 to heater 63. In the example shown, fuser control block 100 includes a temperature control logic block 105 that outputs a temperature delta ΔT representing a difference between a target temperature for heater 63 and an actual temperature sensed by a thermistor 108 in contact with heater 63. Using the temperature delta and/or other accumulated error based on previous measurements, a PID logic block 110 calculates a power output $P_{out}$ indicating a heating power for maintaining the temperature of heater 63 at its target temperature.

A power sequencer 112 receives the calculated power output $P_{out}$ from PID logic block 110 and maps the power output $P_{out}$ to one of a plurality of predetermined power sequences. In one embodiment, each predetermined power sequence takes the form of a pulse width modulated (PWM) signal 115 including a group of heat-on pulses (see FIG. 5) for driving heater 63 at the desired power output to generate heat. A jitter control block 117 adds delay between active portions of the PWM signals 115 from power sequencer 112 so that heat-on pulses tend to overlap with ON regions $T_1$ of the AC line voltage to ensure heater 63 is turned on by the heat-on pulses, as will be discussed in greater detail below. The output of jitter control block 117 is received by a PWM control block 120 which executes every half-cycle and updates PWM high and low times in memory. PWM control block 120 double buffers received PWM signals 115 such that a PWM value written during a half-cycle is read out on a next half-cycle. The output of PWM control block 120 forms the heat-on pulses 80 used by opto triac 85 to generate trigger pulses 90 for triggering triac 75 to pass current from power source 14 through heater 63. Opto triac 85 generates trigger pulses 90 only when the heat-on pulse 80 is high and the AC line voltage is around zero volts (i.e., within ON region $T_1$) as detected by its ZC detector connected across the terminals of power source 14.

Figure 5:
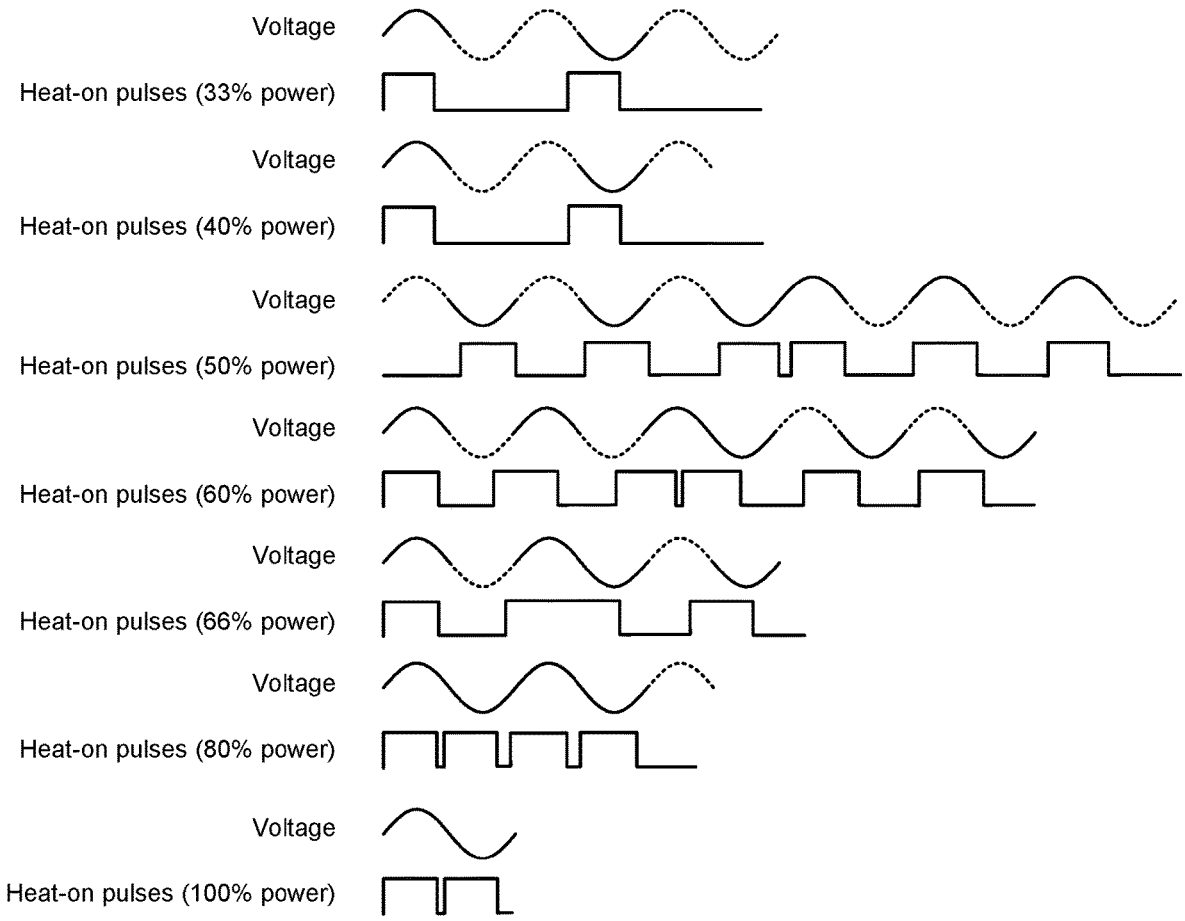
FIG. 5 illustrates example groups of heat-on pulses for different power sequences and their corresponding half-cycle waveform patterns for powering a heater of the fuser assembly.

In order to achieve symmetrical fuser current control and to meet electromagnetic compatibility (EMC) flicker, harmonics, conduction, and radiation certification requirements without zero-cross feedback signal, multiple heat-on pulses for each predetermined power sequence are selected as a group that is sent out together by fuser control block 100 to energize heater 63. Example groups of heat-on pulses for different power sequences and their corresponding half-cycle waveform patterns for powering heater 63 are illustrated in FIG. 5. As shown, each power sequence has its own dedicated heat-on pulse group within a heating power update period defined by multiple AC-half cycles. The group size and pattern vary with power output, and different power outputs have different heat-on pulse patterns.

For each predetermined power sequence, a high heat-on pulse corresponds to a solid half-cycle of the voltage waveform indicating that heater 63 is on while a low heat-on pulse corresponds to a dashed half-cycle of the voltage waveform indicating that heater 63 is off. In the examples shown in FIG. 5, a group including two high heat-on pulses within a six half-cycle power update period delivers a power output of about 33%, a group including two high heat-on pulses within a five half-cycle power update period delivers a power output of about 40%, a group including six high heat-on pulses within a twelve half-cycle power update period delivers a power output of about 50%, a group including six high heat-on pulses within a ten half-cycle power update period delivers a power output of about 60%, a group including four high heat-on pulses within a six half-cycle power update period delivers a power output of about 66%, a group including four high heat-on pulses within a five half-cycle power update period delivers a power output of about 80%, and a group including two high heat-on pulses within a two half-cycle power update period delivers a power output of about 100%. As will be appreciated, other combinations of pulses and power update periods may be used to form power sequences that achieve desired power outputs.

In one embodiment, the heat-on pulses are sent out together as a group and may not be interrupted in the middle of the process. Accordingly, power sequencer 112 reads the next calculated power output from PID logic block 110 only after the end of the half-cycle power update period of the current power sequence. This assures that the current power sequence being applied to heater 63 has completed before the next power sequence is processed. Also, the heat-on pulse period and pulse duty cycle may not be changed until all pulses are sent out. As such, heating power is maintained during the power update period corresponding to the period of time a waveform pattern is applied to heater 63. At the end of each power update period, PWM control block 120 outputs the next PWM signal associated with the next power sequence.

Figure 6:
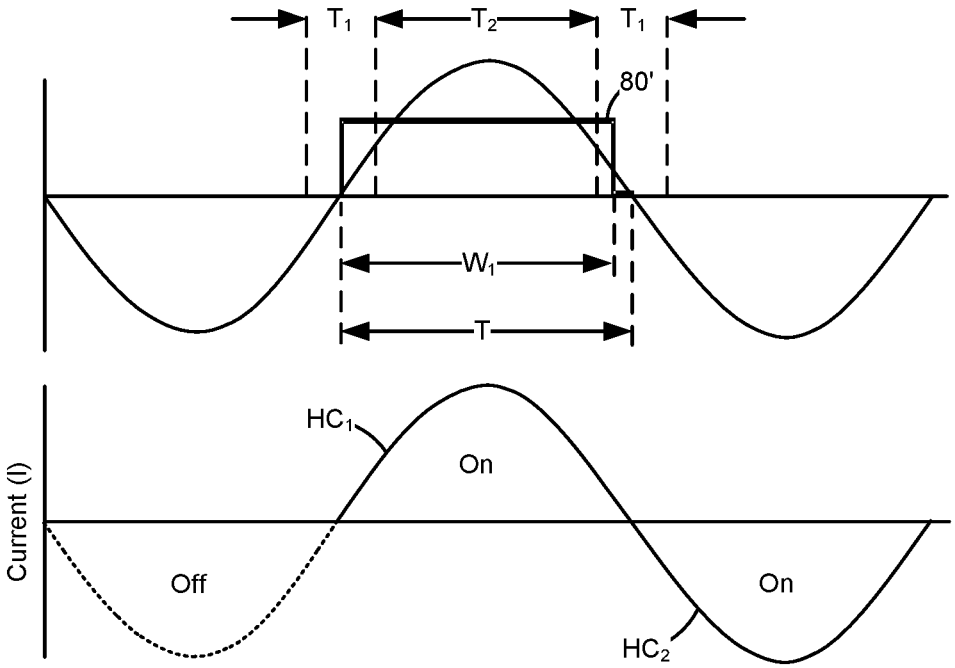
FIG. 6 illustrates an incident where two half-cycles are turned on accidentally by a heat-on pulse.
Figure 7:
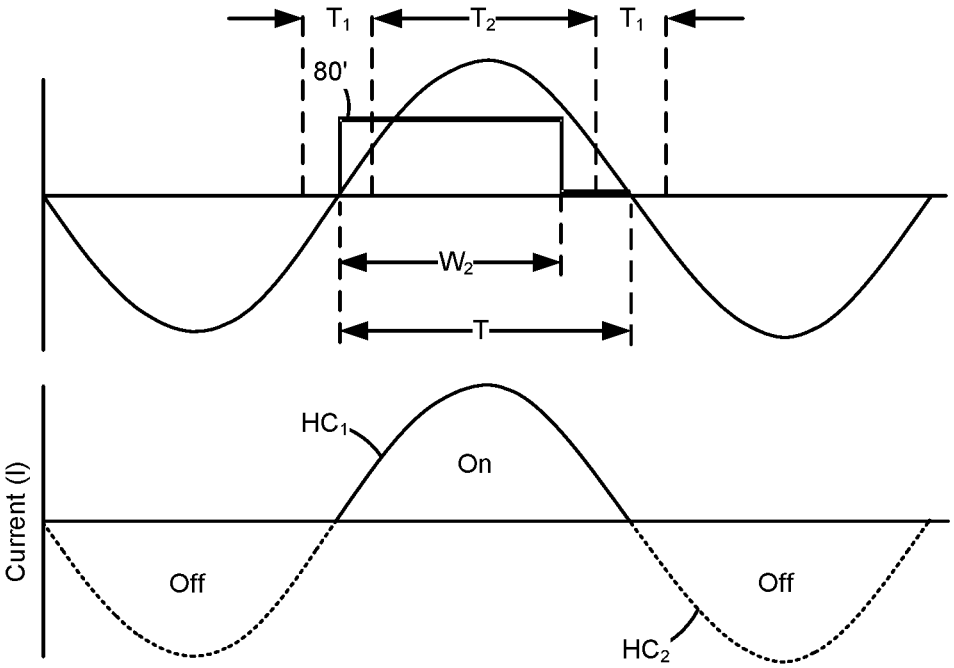
FIG. 7 illustrates a heat-on pulse turning on a single half-cycle according to an example embodiment.

Since there is no zero-cross feedback provided to the controller, a high heat-on pulse may not properly align with AC zero volts and accidentally turn on two AC half-cycles. For example, with reference to FIG. 6, with the heat-on pulse period T set equal to the AC half-cycle time of 50 Hz or 60 Hz (for example, 10 milliseconds for 50 Hz and 8.333 milliseconds for 60 Hz), a single high heat-on pulse 80' having a width $W_1$ may overlap with adjacent ON regions $T_1$ and accidentally turn on both half-cycles $HC_1$, $HC_2$ instead of just one of the two half-cycles. In order to prevent (or substantially reduce the likelihood of) this from occurring, the heat-on pulse duty cycle is set such that the width of a heat-on pulse is shorter than the duration of inhibit region $T_2$. For example, in FIG. 7, the heat-on pulse duty cycle is set such that a heat-on pulse 80 has a width $W_2$ that is greater than the width of ON region $T_1$ but less than the width of inhibit region $T_2$. As a result, heat-on pulse 80 only overlaps with one ON region $T_1$ and turns on half-cycle $HC_1$.

Since the inhibit region $T_2$ varies with AC line voltage, the PWM duty cycle is set such that the width $W_2$ of a high heat-on pulse 80 is shorter than the minimum inhibit region $T_2$ of all voltages supported by the imaging device. On the other hand, there may be failure to turn on the heater when a heat-on pulse 80 is sent out in between two ON regions $T_1$ because its width $W_2$ is shorter than the inhibit region $T_2$. Generally, the shorter the duty cycle of the heat-on pulse, the more chances the heat-on pulse may fall in between and not overlap with adjacent ON regions $T_1$ and fail to turn the heater on. In order to avoid a heat-on pulse turning two AC half-cycles on (FIG. 6) and at the same time minimize the chances of failing to turn on the heater, the duty cycle is set such that the width $W_2$ of a heat-on pulse 80 is as wide as possible (e.g., relatively closer to the heat-on pulse period T but still less than the inhibit region $T_2$). In one example, heat-on pulse duty cycle is set such that the width $W_2$ of a high heat-on pulse state is about 9.5 milliseconds for 50 Hz frequency range (47 Hz to 53 Hz) and about 7.9 milliseconds for 60 Hz frequency range (57 Hz to 63 Hz).

Even though the heat-on pulse width $W_2$ is set as long as possible as discussed above, it is still less than the inhibit region $T_2$ such that a heat-on pulse may still fail to turn on the heater during print when it is sent out by the controller in between two adjacent ON regions $T_1$. The heater off time may extend longer depending on the power update period of a power sequence. Failure to turn on the heater may cause cold offset and/or fuser under temperature error. With the heat-on pulse width $W_2$ already set less than but relatively close to the width of the inhibit region $T_2$, the already tight difference in width between heat-on pulse and inhibit region $T_2$ makes it difficult to overcome (or minimize the occurrence of) such heater off issue by simply increasing the pulse duty cycle.

In one example embodiment, jitter control block 117 (FIG. 4) is used to add jitters or delays to shift heat-on pulses so that they tend to overlap with ON regions $T_1$ of the AC line voltage. For example, if a heat-on pulse 80 falls between two ON regions $T_1$, adding an amount of delay causes the heat-on pulse 80 to overlap with the latter of the two ON regions $T_1$ and turn the heater on. Accordingly, instead of failing to heat the heater (e.g., for an entire duration of a power sequence), the heater off time may be reduced as short as possible to prevent print quality issue and fuser under temperature error. In one embodiment, the delay is triggered based on the frequency of power sequence completions and is injected for one half-cycle each time it is triggered. For example, the delay is added in between two power sequences to avoid generating asymmetrical heater current. In a further embodiment, the delay is set by increasing the low time of the PWM signal from power sequencer 112 so that the width of the active portions (i.e., high times) of the PWM signal may not be affected. The delay size is optimized so that the heater may be turned on in the next power sequence if the heater is off in the previous power sequence. In one example, the amount of delay added in between two power sequences is about 0.5 milliseconds.

Figure 8:
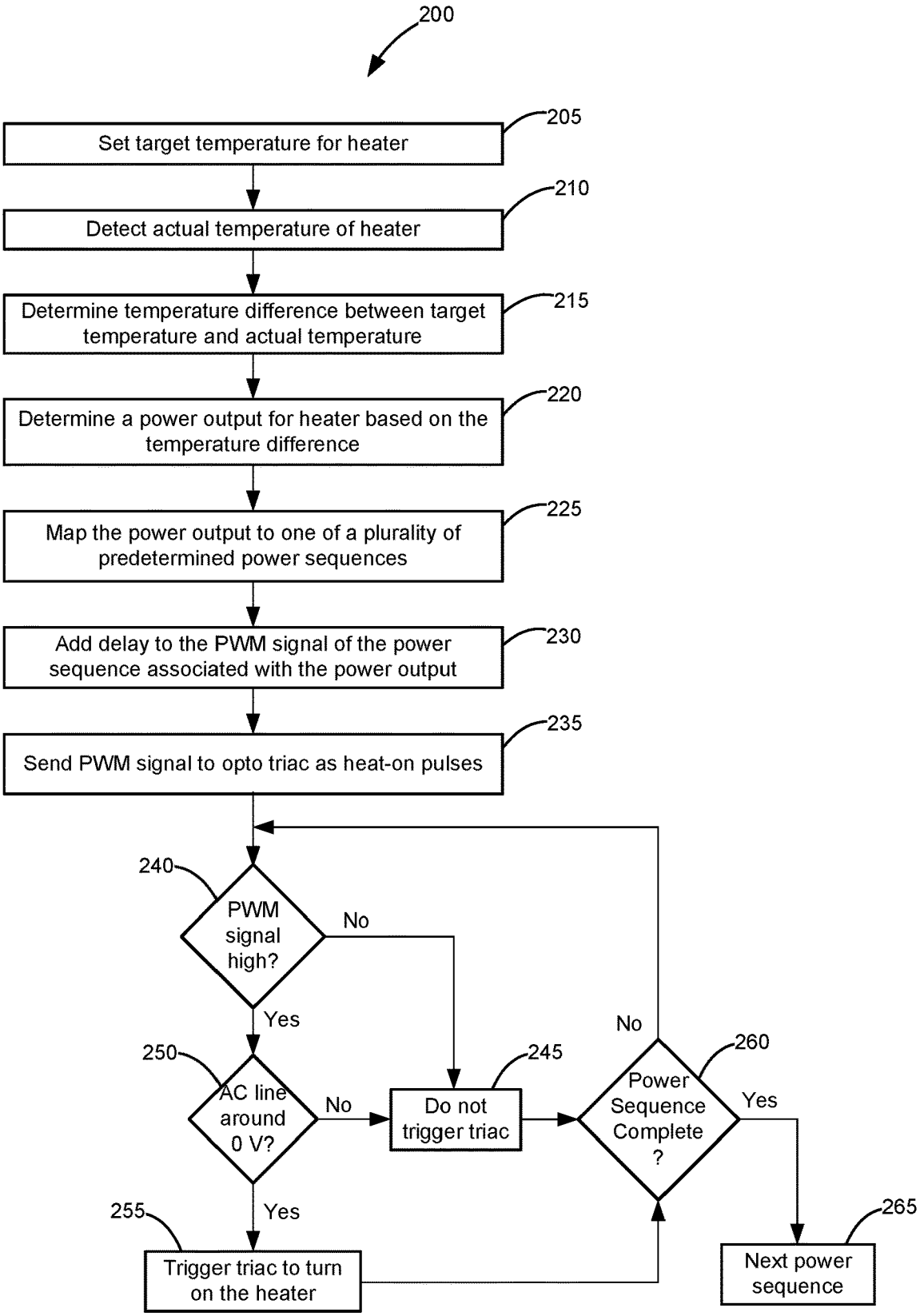
FIG. 8 is a flowchart of an example method for controlling power delivered to the fuser according to an example embodiment.

Referring now to FIG. 8, an example method 200 for controlling power delivered to the fuser is illustrated. At block 205, a target temperature for heater 63 is set. Actual temperature of heater 63 is detected at block 210 using thermistor 108. At block 215, a difference between the target temperature and actual temperature of heater 63 is determined. Based on the temperature difference, a required power output to be delivered to the heater to achieve the target temperature is determined at block 220. At block 225, the determined power output is sent to power sequencer 112 which maps the power output to one of the plurality of predetermined power sequences. At block 230, jitter control block 117 adds a delay to the PWM signal of the power sequence associated with the power output. At block 235, PWM control block 120 buffers the PWM signal from the jitter control block 117 so that high and low states of the PWM signal are output sequentially to opto triac 85 as heat-on pulses.

Based on the heat-on pulses and zero-cross detections of its ZC detector, opto triac 85 selectively triggers triac 75 to turn on the heater. If the PWM signal is not at a high state (i.e., PWM signal is low) at block 240, then opto triac 85 does not trigger triac 75 at block 245. If, at block 240, the PWM signal is at a high state and the AC line voltage is around 0 volts (i.e., within the ON region $T_1$) at block 250, then opto triac 85 sends a trigger pulse to triac 75 to turn on the heater at block 255. Otherwise, if the PWM signal is at a high state at block 240 but the AC line voltage is within the inhibit region $T_2$, then opto triac 85 does not trigger triac 75 at block 245. If, at block 260, the application of the power sequence is not yet complete, the process proceeds back to block 240 where opto triac 85 continues to receive the PWM signal of the power sequence. If the power sequence has been completed at block 260, then the next power sequence is determined (e.g., block 215 through block 225) and used to control triggering of heater 63 at block 265.

Although the example embodiments discussed above have been described in the context of using an opto triac for triggering a triac to achieve multiple AC half-cycle control in powering a fuser without providing zero-cross feedback to the controller, it will be appreciated that the teachings and concepts provided herein may utilize other electronic and/or semiconductor devices used in power control and switching applications.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. A method for controlling power delivered to a fuser in an imaging device, the fuser having a heater connected to a power source via a switch, the method comprising:

receiving a heater control signal for driving the heater to generate heat, the heater control signal changing between a first state indicating for the heater to be turned on and a second state indicating for the heater to be turned off;

detecting whether an alternating current (AC) voltage of the power source is within a predefined voltage span around zero volts;

in response to detecting that the AC voltage is within the predefined voltage span while the heater control signal is in the first state, sending a trigger signal to the switch to turn on the heater by allowing current to pass through from the power source to the heater; and bypassing the sending the trigger signal to the switch in response to detecting that the AC voltage is within the predefined voltage span while the heater control signal is in the second state.

2. The method of claim 1, wherein the receiving the heater control signal includes receiving a predetermined group of pulses.

3. The method of claim 1, wherein the receiving the heater control signal includes receiving a predetermined pulse waveform pattern.

4. The method of claim 1, wherein the receiving the heater control signal includes receiving a plurality of predetermined pulse waveform patterns with a predetermined delay between successive predetermined pulse waveform patterns.

5. The method of claim 1, wherein the receiving the heater control signal includes receiving a plurality of pulses with each pulse having a pulse width that is greater than a width defined by the predefined voltage span.

6. The method of claim 1, wherein the detecting whether the AC voltage of the power source is within the predefined voltage span includes detecting whether the AC voltage is between about −20 volts and about +20 volts.

7. A method for controlling power delivered to a fuser in an imaging device, the fuser having a heater connected to a power source via a switch, the method comprising:

generating, by a controller, a heater control signal for driving the heater to generate heat without synchronizing the generation of the heater control signal with zero crossings of an alternating current (AC) voltage of the power source, the heater control signal changing between a first state indicating for the heater to be turned on and a second state indicating for the heater to be turned off;

receiving, by a trigger circuit, the heater control signal;

detecting, by the trigger circuit, whether the AC voltage of the power source is within a predefined voltage span around zero volts;

generating, by the trigger circuit, a trigger signal for the switch in response to detecting that the AC voltage is within the predefined voltage span while the heater control signal is in the first state;

connecting, by the switch, the heater to the power source in response to receiving the trigger signal such that current passes from the power source through the heater; and bypassing the generating the trigger signal in response to detecting that the AC voltage is outside the predefined voltage span regardless of whether the heater control signal is in the first state or the second state.

8. The method of claim 7, wherein the receiving the heater control signal includes receiving a plurality of predetermined pulse waveform patterns.

9. The method of claim 8, further comprising setting a delay between successive predetermined pulse waveform patterns.

10. The method of claim 9, wherein the setting the delay includes increasing a low time of the heater control signal corresponding to the second state between successive predetermined pulse waveform patterns.

11. The method of claim 7, wherein the receiving the heater control signal includes receiving a plurality of pulses with each pulse having a pulse width that is greater than a width defined by the predefined voltage span.

12. The method of claim 7, wherein the detecting whether the AC voltage of the power source is within the predefined voltage span includes detecting whether the AC voltage is between about −20 volts and about +20 volts.

13. An imaging device, comprising:

a fuser having a heater for generating heat to fuse toner images onto sheets of media;

a power source for supplying power to the heater;

a switch connected between the heater and the power source for selectively allowing current to pass from the power source through the heater;

a controller operative to generate a heater control signal for driving the heater to generate heat without synchronizing the generation of the heater control signal with zero crossings of an alternating current (AC) voltage of the power source, the heater control signal changing between a first state indicating for the heater to be turned on and a second state indicating for the heater to be turned off; and a trigger circuit coupled to the controller to receive the heater control signal therefrom, wherein the trigger circuit is operative to detect whether the AC voltage of the power source is within a predefined voltage span around zero volts and to generate a trigger signal for the switch in response to detecting that the AC voltage is within the predefined voltage span while the heater control signal is in the first state such that the switch causes current to pass through from the power source to the heater, wherein the trigger circuit bypasses generation of the trigger signal in response to detecting that the AC voltage is within the predefined voltage span while the heater control signal is in the second state.

14. The imaging device of claim 13, wherein the switch includes a triac.

15. The imaging device of claim 13, wherein the trigger circuit includes an opto triac.

16. A method for controlling power delivered to a fuser in an imaging device, the fuser having a heater connected to a power source via a switch, the method comprising:

receiving a heater control signal for driving the heater to generate heat, the heater control signal changing between a first state indicating for the heater to be turned on and a second state indicating for the heater to be turned off;

detecting whether an alternating current (AC) voltage of the power source is within a predefined voltage span around zero volts;

in response to detecting that the AC voltage is within the predefined voltage span while the heater control signal is in the first state, sending a trigger signal to the switch to turn on the heater by allowing current to pass through from the power source to the heater; and bypassing the sending the trigger signal to the switch in response to detecting that the AC voltage is outside the predefined voltage span regardless of whether the heater control signal is in the first state or the second state.

* * * * *